United States Patent [19]

Söderström

[11] 4,254,512

[45] Mar. 10, 1981

[54] WATER TRAP

[76] Inventor: Gert Söderström, 62 Hammarbyvägen, Upplands Väsby, Sweden, S-194 00

[21] Appl. No.: 971,747

[22] Filed: Dec. 21, 1978

[30] Foreign Application Priority Data

Dec. 22, 1977 [CH] Switzerland ..... 14652/77

[51] Int. Cl.[3] ..... E03C 1/22; E03C 1/284; E03C 1/29; E03F 5/04

[52] U.S. Cl. ..... 4/191; 4/197; 4/206; 137/247.27; 137/247.29

[58] Field of Search ..... 4/146, 189, 190, 197, 4/206, 207, 286, 288–293, 584, 596, 619, 637, 638, 640–642, 650, 652, 653, 656, 191; 137/247, 247.27, 247.35, 254, 247.29, 247.33; 141/331

[56] References Cited

U.S. PATENT DOCUMENTS

| | | | |
|---|---|---|---|
| 89,858 | 5/1869 | Graigie | 137/247.27 |
| 493,750 | 3/1893 | Budde | 137/247.35 X |
| 1,181,961 | 5/1916 | Windberg | 137/247.35 |
| 1,265,291 | 5/1918 | Bergman | 4/206 |
| 1,790,603 | 1/1931 | Sisk | 137/247.35 X |
| 1,833,303 | 11/1931 | Pritchard | 137/247.27 X |
| 2,101,978 | 12/1937 | Boosey | 137/247.35 X |
| 2,218,276 | 10/1940 | Woodin | 4/190 |
| 2,491,328 | 12/1949 | Muller | 137/247.29 |
| 3,066,802 | 12/1962 | Löffler | 4/292 X |
| 3,751,734 | 8/1973 | Lumadue | 4/197 |

FOREIGN PATENT DOCUMENTS

| | | | |
|---|---|---|---|
| 2359686 | 8/1974 | Fed. Rep. of Germany | 4/197 |
| 94075 | 8/1956 | Netherlands | 137/247.27 |

*Primary Examiner*—Stuart S. Levy

*Attorney, Agent, or Firm*—Schuyler, Banner, Birch, McKie & Beckett

[57] ABSTRACT

A water trap for use in sinks and other drains, wherein two members which together form a water seal are adjustably and releasably secured together by a threaded connection. Means may be provided for handling water from two separate sources, wherein the trap performs two separate trap functions but ensures that a water seal will always be maintained even though only one source may be draining into the trap.

2 Claims, 5 Drawing Figures

WATER TRAP

This invention relates to a water trap intended to be inserted into a draining gutter and the like. The water trap has the object to render it possible to clean underlying drainpipes in a simple and efficient way. A further object of the invention is to provide an adjustable and easily installable device which will solve problems arising in connection with water traps, especially in sinks.

According to the invention, therefore, the water trap consists of an upper member in the form of a tubular pipe socket immersed into and detachably secured to a lower cup-shaped member, the entire assembly being detachably secured to the surrounding drain structure.

Figure 1:
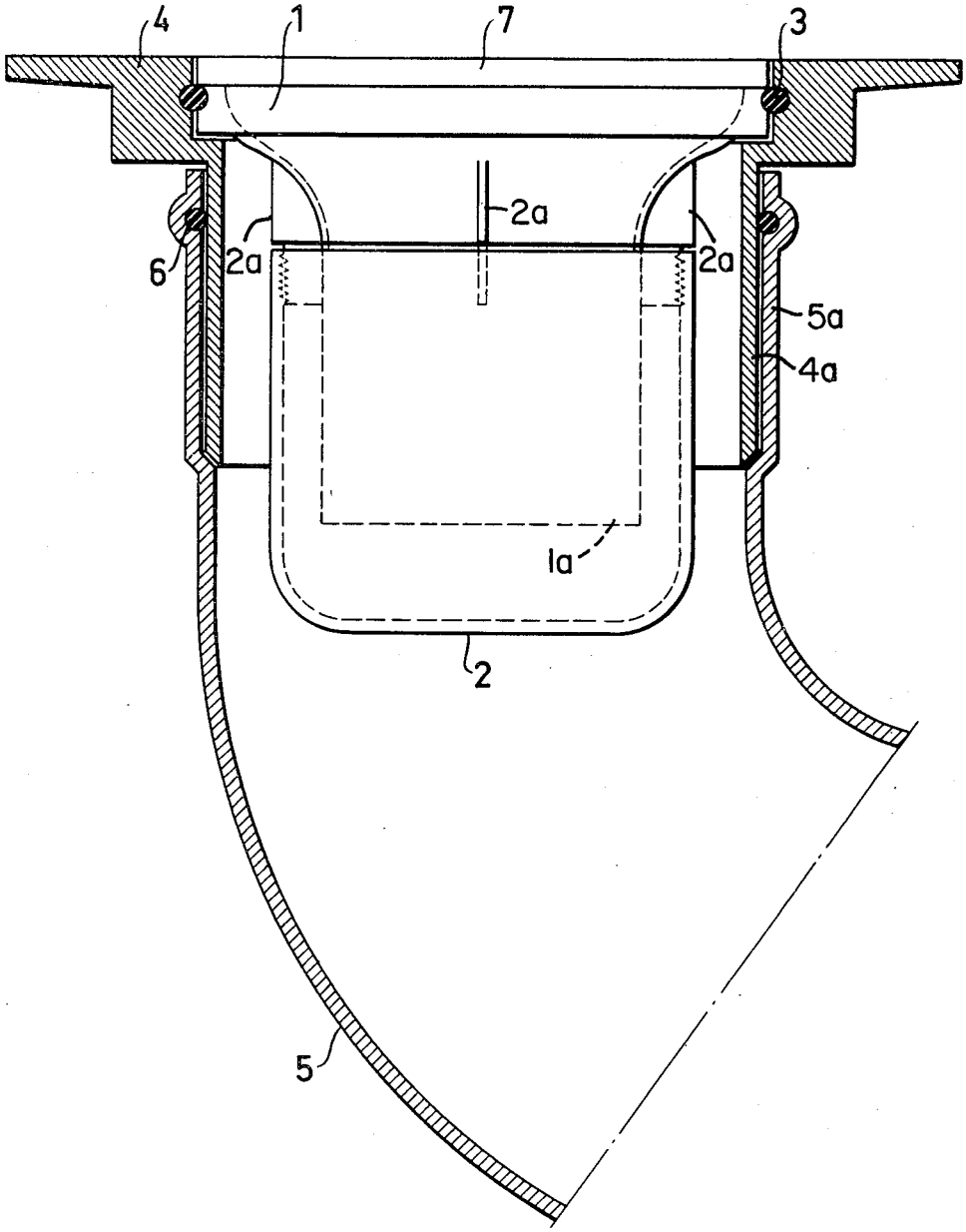
Figure 2:
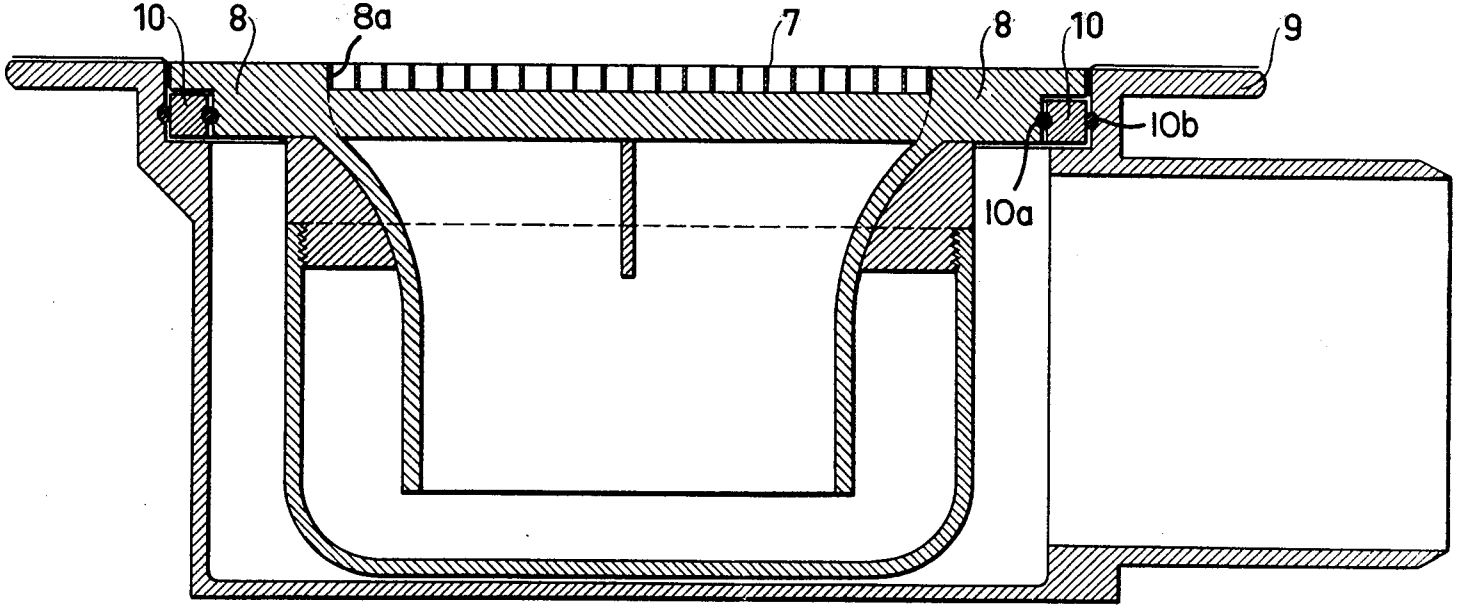
Figure 3:
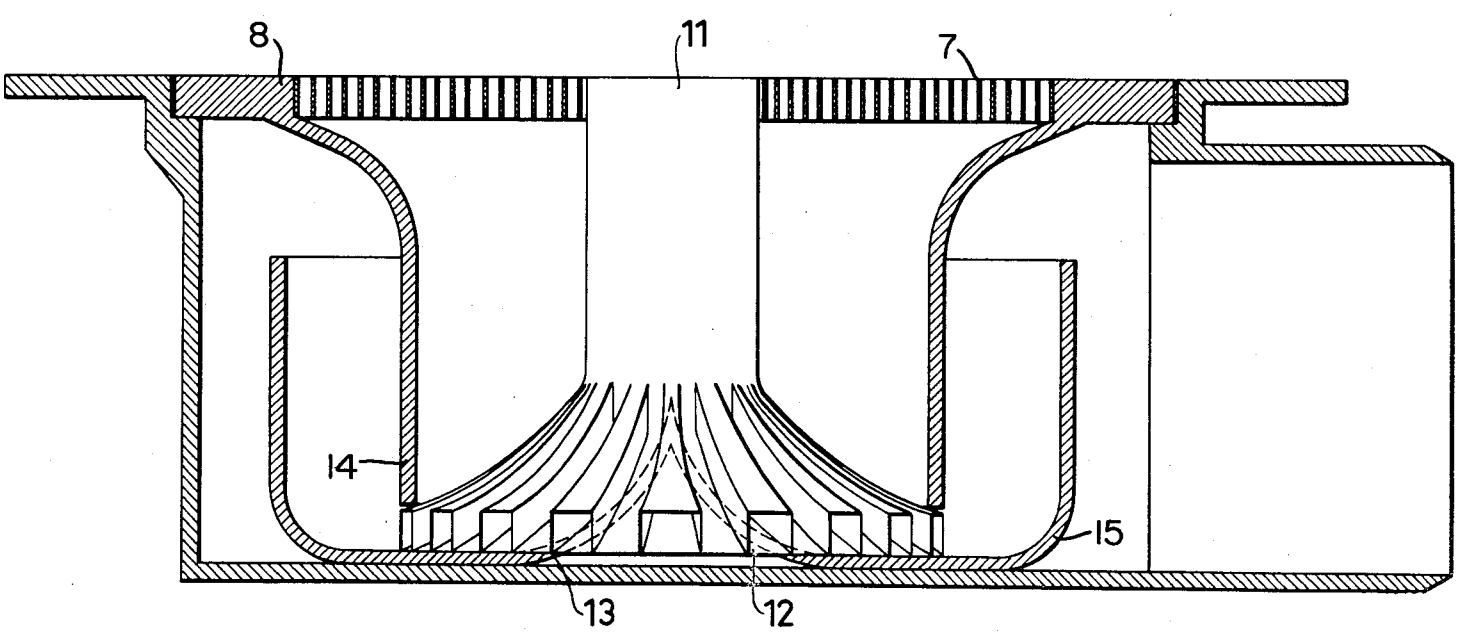
Figure 4:
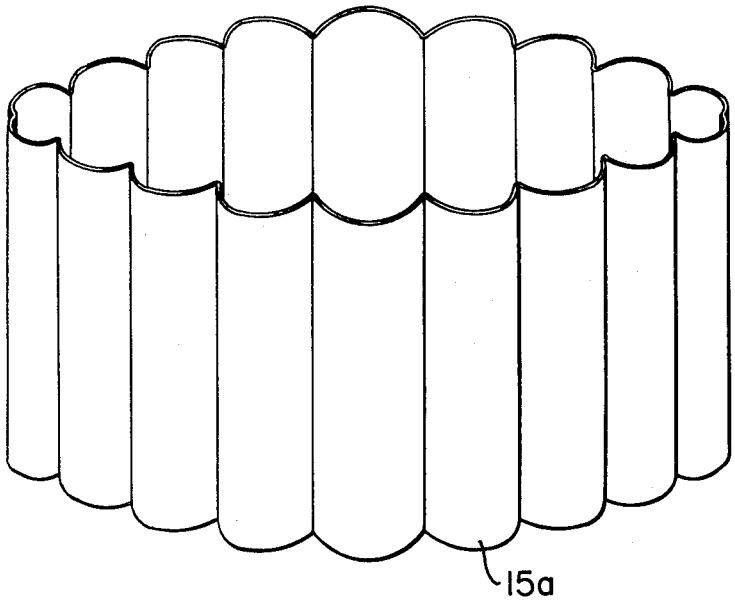
Figure 5:
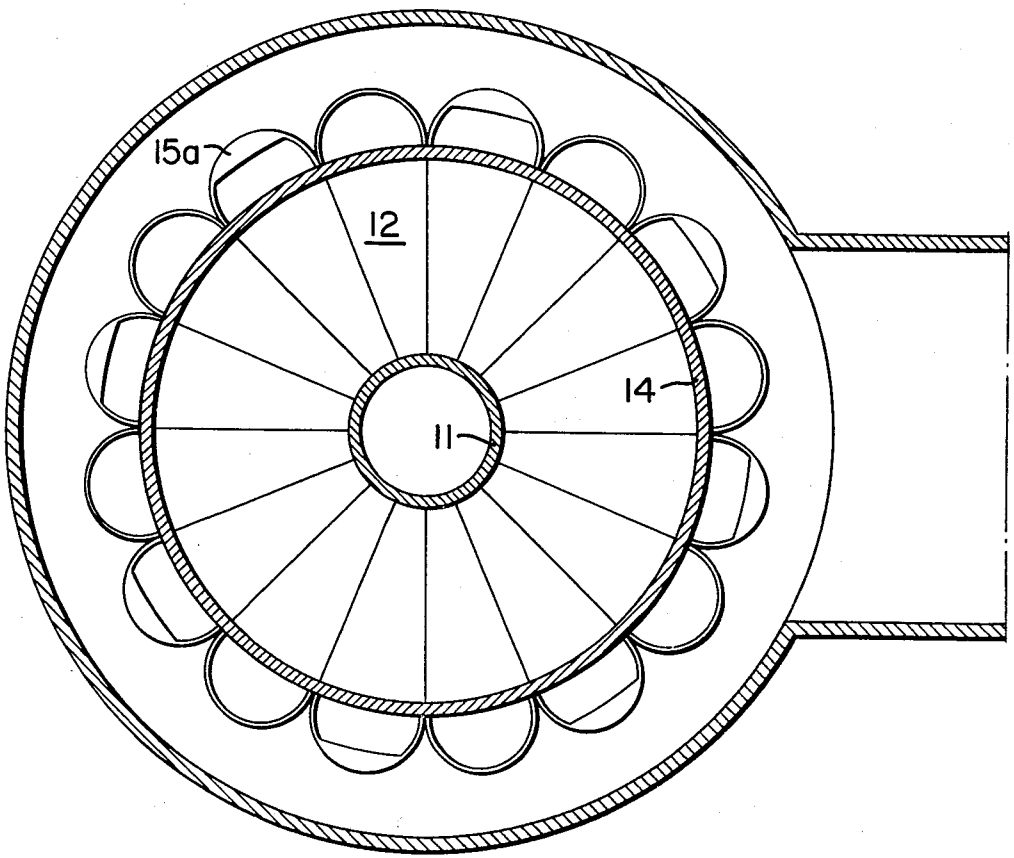

The invention is described in greater detail in the following by way of embodiments shown in the accompanying drawings, in which FIG. 1 shows a water trap according to the invention mounted in an open pipe bend, FIG. 2 shows the water trap according to the invention mounted in a sink, FIG. 3 shows a further variant of the water trap according to the invention, which is intended especially for use in bathrooms and the like, FIG. 4 shows the lower portion of the water trap in FIG. 3, and FIG. 5 shows, partially in section, the water trap in FIG. 3 seen from above.

The water trap shown in FIG. 1 comprises an upper member 1, which from its upper end tapers to a lower pipe socket 1*a*, which constitutes the upper lip of the water trap proper and is immersed into a cup 2 constituting the lower member of the water trap. Said cup 2 is connected to the upper member 1 of the water trap via radial flanges 2*a* provided thereon and threaded so as to engage with a corresponding thread in the upper edge of the cup 2. The water trap is then inserted into a floor connection 4, with an O-ring 3 laid therebetween, which connection at its lower end transforms to a pipe socket 4*a*, which in its turn is inserted into the upper portion 5*a* of a drainpipe 5, with an O-ring 6 laid therebetween. In this way it is possible to adjust the sink height so that it easily can be fitted to the floor height without affecting in any way the water trap. Above the water trap a strainer 7 is applied.

The installation shown, which without any disadvantages whatsoever can replace the cleaning openings to be found in all buildings, can be cleaned in an easy way by lifting off first the strainer and then the water trap consisting of the members 1 and 2, whereafter the entire drain cross-section is accessible which often is a prerequsite condition for being able to efficiently clean the pipe. The O-ring 3 is retained in grooves are provided both in the floor connection 4 and in the upper water trap member 1 in order to ensure that the water trap sealingly snaps into the intended position.

The embodiment shown in FIG. 2, with respect to the upper water trap member 1 proper, is almost identical with the embodiment of the invention shown in FIG. 1. The upper member 8 of the water trap, however, constitutes a somewhat larger member and is provided on the upper surface with a special recess 8*a* for receiving a strainer. The outer sink casing is designated by 9. For rendering it possible to easily clean the drain by removing the entire water trap insert, so that the entire drain cross-section becomes accessible without affecting the installation of the floor-covering connected to the sink, a clamping ring 10 retaining the same is inserted into the sink casing, with O-rings 10*a* and 10*b* laid therebetween in the same way as in FIG. 1 for sealing between the water trap and the locking ring and, respectively, between the locking ring and the sink casing.

FIG. 3 shows in a simplified manner a further development of the sink shown in FIG. 2. It comprises, in addition to the aforementioned details, a pipe 11, which starts on the same level as the sink strainer and flares outwardly at its lower end to a funnel-shaped corrugated branching, which extends outward and beneath the lower edge 14 of the upper member. The pipe 11 constitutes a connection, for example for bathwater or water from a washing or dish-washing machine. The corrugation of the funnel-shaped portion 12 ensures, that both water flowing down through the strainer 7 and water supplied through the pipe 11 flows out into the second chamber of the water trap. In the bottom of the lower cup 15 of the water trap a central upward-projecting portion 13 is provided in order to prevent particle precipitation taking place there. By this design the risk is reduced that water from the bath tub causes the sink to flood. The lower cup member as shown in FIG. 3 advantageously may have the scalloped form shown at 15*a* in FIG. 4. The corrugations in the inner water guide portion 13 preferably are here arranged to correspond to the number of passageways in the water trap element shown, thereby rendering two separate water traps. For attaching at the upper member of the water trap the cup member can be provided with threads or other locking means at its inward facing edges.

FIG. 5 shows the application of the water trap member shown in FIG. 4 together with the sink shown in FIG. 4.

As is evident from above, the invention provides a water trap easy to handle in drain installations, which trap renders possible simple, efficient cleaning and safe operation.

What I claim is:

1. A water trap for use in sinks and other drains comprising:

an upper tubular drain member having an upper inlet and a lower edge defining an outlet;

a lower cup-shaped member having a closed bottom and an upper overflow edge, said lower member surrounding a lower portion of said upper member with said lower edge disposed between said bottom and said overflow edge to define an annular gap between said members; and an auxiliary drain pipe disposed concentrically within and occupying a portion of said upper member, said auxiliary drain pipe extending from said inlet to below said lower edge to define two separate fluid flow paths from said inlet to said annular gap, and having a corrugated bottom portion which flares outwardly to below said lower edge to define alternating channels of said two flow paths.

2. A water trap according to claim 1 wherein the outer wall of said lower member which surrounds said upper member is scalloped and cooperates with said corrugated portion to define extensions of said alternating channels which carry separate fluid streams to said overflow edge.

* * * * *

UNITED STATES PATENT AND TRADEMARK OFFICE

CERTIFICATE OF CORRECTION

PATENT NO. : 4,254,512

DATED : March 10, 1981

INVENTOR(S) : Gert Soderstrom

It is certified that error appears in the above-identified patent and that said Letters Patent are hereby corrected as shown below:

On the first page of the patent, under the heading "Foreign Application Priority Data", "Switzerland" should be —Sweden—.

Signed and Sealed this

*Fifteenth* Day of *September 1981*

[SEAL]

*Attest:*

GERALD J. MOSSINGHOFF

*Attesting Officer*

*Commissioner of Patents and Trademarks*